US006460215B1

(12) United States Patent
Dues et al.

(10) Patent No.: US 6,460,215 B1
(45) Date of Patent: Oct. 8, 2002

(54) TOILET CLEANING APPARATUS

(76) Inventors: Suzette Dues, P.O. Box 365, Penns Grove, NJ (US) 08069; Tina Waye, 258 Dixie Dr., Carneys Point, NJ (US) 08069; De Haven Robinson, 178 S. Broad St., Penns Grove, NJ (US) 08069

( * ) Notice: Subject to any disclaimer, the term of this patent is extended or adjusted under 35 U.S.C. 154(b) by 0 days.

(21) Appl. No.: 09/822,400

(22) Filed: Mar. 30, 2001

(51) Int. Cl.[7] ..... A46B 9/02
(52) U.S. Cl. ..... 15/160; 15/186; 15/104.16
(58) Field of Search ..... 15/104.16, 104.2, 15/160, 164, 186, 188

(56) References Cited

U.S. PATENT DOCUMENTS

| | | | | |
|---|---|---|---|---|
| 430,767 | A | * | 6/1890 | Brady |
| 2,127,674 | A | * | 8/1938 | Clarke |
| 2,739,330 | A | * | 3/1956 | Hitchcock |
| 2,878,501 | A | * | 3/1959 | Brennan |
| 3,085,272 | A | * | 4/1963 | Weichselbaum |
| 3,599,263 | A | | 8/1971 | Chelten |
| 4,700,423 | A | * | 10/1987 | Zuliani |
| 4,781,139 | A | | 11/1988 | Burgers |
| 4,967,441 | A | | 11/1990 | White |
| 5,033,155 | A | | 7/1991 | Klotz |
| D360,986 | S | | 8/1995 | Hoagland |
| 5,440,775 | A | * | 8/1995 | Banks |
| 5,491,863 | A | * | 2/1996 | Dunn |
| 5,511,274 | A | * | 4/1996 | Lewis, Jr. |
| 5,878,459 | A | | 3/1999 | Mcparland |
| 5,926,895 | A | * | 7/1999 | Roy |
| 5,984,555 | A | | 11/1999 | Samad |
| 6,134,738 | A | * | 10/2000 | Weber |
| 6,154,913 | A | * | 12/2000 | Burton |

FOREIGN PATENT DOCUMENTS

| | | |
|---|---|---|
| IT | 0292523 | * 12/1935 |

* cited by examiner

*Primary Examiner*—Randall E. Chin

(57) ABSTRACT

A toilet cleaning apparatus for reducing the time required to clean a toilet bowl and providing improved results. The toilet cleaning apparatus includes a handle portion which is substantially elongate and includes a proximal end designed for grasping by a human hand and a distal end, and a brush member, which is coupled to said distal end of said handle portion and used for cleaning an interior surface of a toilet.

9 Claims, 2 Drawing Sheets

TOILET CLEANING APPARATUS

BACKGROUND OF THE INVENTION

1. Field of the Invention

The present invention relates to toilet brushes and more particularly pertains to a new toilet cleaning apparatus for reducing the time required to clean a toilet bowl and providing improved results.

2. Description of the Prior Art

The use of toilet brushes is known in the prior art. More specifically, toilet brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,781,139; U.S. Pat. No. 5,878,459; U.S. Pat. No. 3,599,263; U.S. Pat. No. 5,033,155; U.S. Pat. No. 4,967,441; U.S. Pat. No. 5,984,555; and U.S. Pat. No. Des. 360,986.

While these devices fulfill their respective, particular objectives and requirements, the aforementioned patents do not disclose a new toilet cleaning apparatus. The inventive device includes a handle portion which is substantially elongate and includes a proximal end designed for grasping by a human hand and a distal end, and a brush member, which is coupled to said distal end of said handle portion and used for cleaning an interior surface of a toilet.

In these respects, the toilet cleaning apparatus according to the present invention substantially departs from the conventional concepts and designs of the prior art, and in so doing provides an apparatus primarily developed for the purpose of reducing the time required to clean a toilet bowl and providing improved results.

SUMMARY OF THE INVENTION

In view of the foregoing disadvantages inherent in the known types of toilet brushes now present in the prior art, the present invention provides a new toilet cleaning apparatus construction wherein the same can be utilized for reducing the time required to clean a toilet bowl and providing improved results.

The general purpose of the present invention, which will be described subsequently in greater detail, is to provide a new toilet cleaning apparatus apparatus and method which has many of the advantages of the toilet brushes mentioned heretofore and many novel features that result in a new toilet cleaning apparatus which is not anticipated, rendered obvious, suggested, or even implied by any of the prior art toilet brushes, either alone or in any combination thereof.

To attain this, the present invention generally comprises a handle portion which is substantially elongate and includes a proximal end designed for grasping by a human hand and a distal end, and a brush member, which is coupled to said distal end of said handle portion and used for cleaning an interior surface of a toilet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet cleaning apparatus apparatus and method which has many of the advantages of the toilet brushes mentioned heretofore and many novel features that result in a new toilet cleaning apparatus which is not anticipated, rendered obvious, suggested, or even implied by any of the prior art toilet brushes, either alone or in any combination thereof.

It is another object of the present invention to provide a new toilet cleaning apparatus which may be easily and efficiently manufactured and marketed.

It is a further object of the present invention to provide a new toilet cleaning apparatus which is of a durable and reliable construction.

An even further object of the present invention is to provide a new toilet cleaning apparatus which is susceptible of a low cost of manufacture with regard to both materials and labor, and which accordingly is then susceptible of low prices of sale to the consuming public, thereby making such toilet cleaning apparatus economically available to the buying public.

Still yet another object of the present invention is to provide a new toilet cleaning apparatus which provides in the apparatuses and methods of the prior art some of the advantages thereof, while simultaneously overcoming some of the disadvantages normally associated therewith.

Still another object of the present invention is to provide a new toilet cleaning apparatus for reducing the time required to clean a toilet bowl and providing improved results.

Yet another object of the present invention is to provide a new toilet cleaning apparatus which includes a handle portion which is substantially elongate and includes a proximal end designed for grasping by a human hand and a distal end, and a brush member, which is coupled to said distal end of said handle portion and used for cleaning an interior surface of a toilet.

Still yet another object of the present invention is to provide a new toilet cleaning apparatus that provides a fresher smelling bathroom.

Even still another object of the present invention is to provide a new toilet cleaning apparatus that decreases the time required to clean toilets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
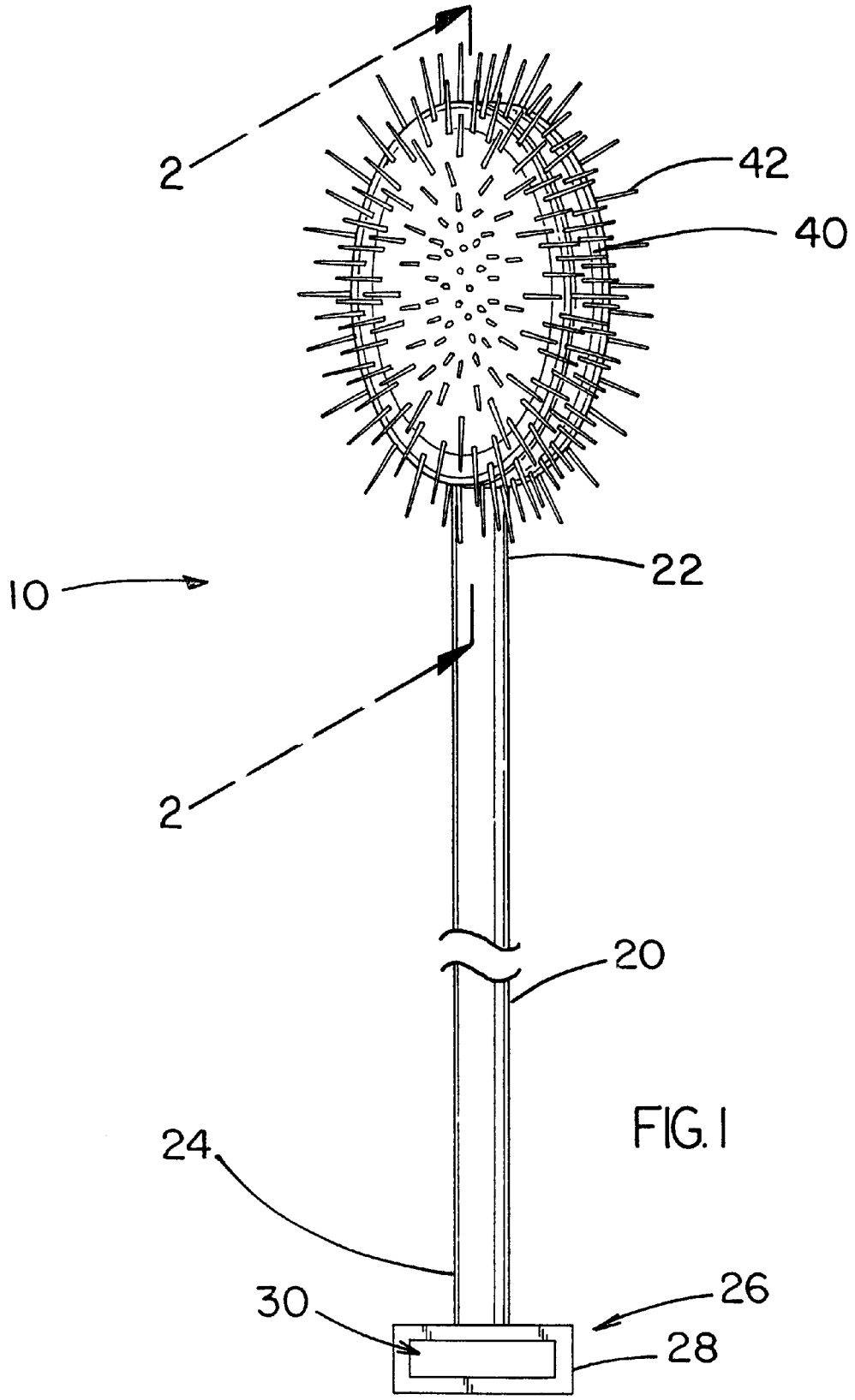
FIG. 1 is a schematic perspective view of a new toilet cleaning apparatus according to the present invention.
Figure 2:
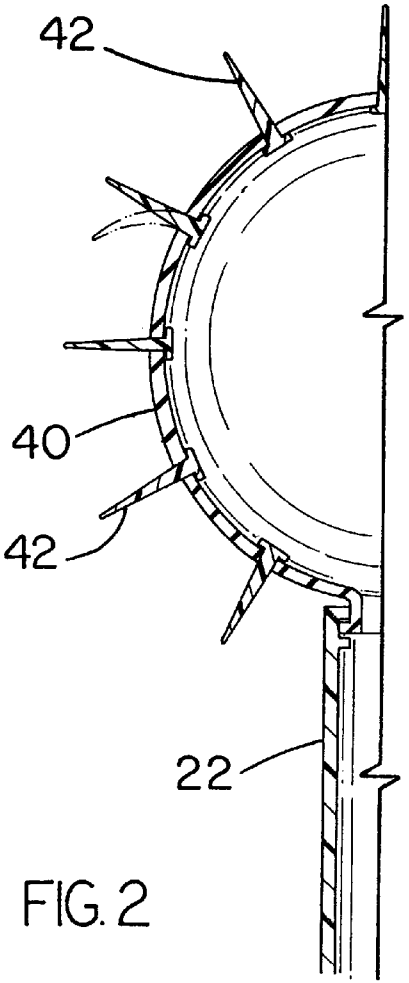
FIG. 2 is a schematic cross-sectional view of the present invention taken along line 2—2 of FIG. 1.
Figure 3:
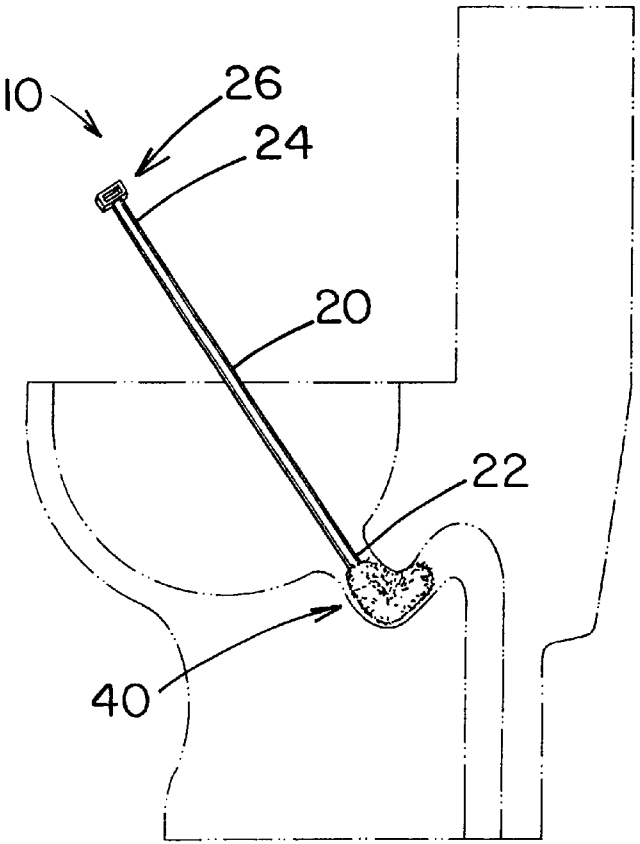
FIG. 3 is a schematic side view of the present invention in use.

With reference now to the drawings, and in particular to FIGS. 1 through 3 thereof, a new toilet cleaning apparatus embodying the principles and concepts of the present invention and generally designated by the reference numeral 10 will be described.

As best illustrated in FIGS. 1 through 3, the toilet cleaning apparatus 10 generally comprises a handle portion 20 and a brush member 40.

The handle portion 20 is substantially elongate. The handle portion 20 includes a proximal end 24 and a distal end 22. The proximal end 24 is designed for grasping by a human hand.

The brush member 40 is coupled to the distal end 22 of the handle portion 20. The brush member 40 is for cleaning an interior surface of a toilet.

The handle portion 20 further comprises a grip portion 26 coupled to the proximal end 24. The grip portion 26 includes a perimeter wall 28 , which defines an aperture 30 designed for inserting the fingers of a human hand to facilitate gripping the handle portion 20.

The grip portion 26 is positioned such that a longitudinal axis of the grip portion 26 is substantially perpendicular to a longitudinal axis of the handle portion 20.

In an embodiment the handle portion 20 comprises a polymeric material.

The brush member 40 further comprises a plurality of bristle members 42 interspersed across an exterior surface of the brush member 40. Each one of the plurality of bristle members 42 provides an abrasive force for facilitating cleaning the interior surface of the toilet.

Each one of the plurality of bristle members 42 is resiliently flexible for facilitating contact with the interior surface of the toilet.

In a further embodiment each one of the plurality of bristle members 42 comprises an elastomeric material.

The brush member 40 is resiliently flexible for facilitating placement of the brush member 40 substantially within a drain opening of the toilet for cleaning an interior surface of the drain opening.

In an embodiment the brush member 40 is pivotally coupled to the handle portion 20 for facilitating placement of the brush member 40 against the interior surface of the toilet.

In a further embodiment, the handle portion 20 has an overall length of approximately 14 ½ inches.

In still a further embodiment, the brush member 40 has a length of approximately 8 ¼ inches and a width of approximately 4 ¼ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet cleaning apparatus comprising:

a handle portion being substantially elongate, said handle portion having a proximal end and a distal end, said proximal end being adapted for grasping by a human hand;

a brush member being coupled to said distal end of said handle portion, said brush member being for cleaning an interior surface of a toilet;

a grip portion coupled to said proximal end, said grip portion having a perimeter wall defining an aperture adapted for inserting the fingers of a human hand to facilitate gripping the handle; and wherein said grip portion is positioned such that a longitudinal axis of said grip portion is substantially perpendicular to a longitudinal axis of said handle portion;

said brush member having a first face defining a first plane;

said grip portion having a substantially rectangular cross-section, said cross section defining a second plane, said grip portion being positioned such that said second plane has an angular relationship to said first plane;

wherein each one of said plurality of bristle members is resiliently flexible for facilitating contact with the interior surface of the toilet; and wherein each one of said plurality of bristle members comprises an elastomeric material.

2. The toilet cleaning apparatus of claim 1, wherein said handle portion comprises a polymeric material.

3. The toilet cleaning apparatus of claim 1 wherein said brush member further comprises:

a plurality of bristle members interspersed across an exterior surface of said brush member, each one of said plurality of bristle members providing an abrasive force for facilitating cleaning the interior surface of the toilet.

4. The toilet cleaning apparatus of claim 1, wherein said brush member being resiliently flexible for facilitating placement of said brush member substantially within a drain opening of the toilet for cleaning an interior surface of said drain opening.

5. The toilet cleaning apparatus of claim 1, wherein said brush member being pivotally coupled to said handle portion for facilitating placement of said brush member against the interior surface of the toilet.

6. The toilet cleaning apparatus of claim 1, wherein said handle portion has an overall length of approximately 14 ¼ inches.

7. The toilet cleaning apparatus of claim 1, wherein said brush member has a length of approximately 8 ¼ inches and a width of approximately 4 ¼ inches.

8. A toilet cleaning apparatus comprising:

a handle portion being substantially elongate, said handle portion having a proximal end and a distal end, said proximal end being adapted for grasping by a human hand;

a brush member being coupled to said distal end of said handle portion, said brush member being for cleaning an interior surface of a toilet;

a grip portion coupled to said proximal end, said grip portion having a perimeter wall defining an aperture adapted for inserting the fingers of a human hand to facilitate gripping the handle; and wherein said grip portion is positioned such that a longitudinal axis of said grip portion is substantially perpendicular to a longitudinal axis of said handle portion;

said brush member having a first face defining a first plane;

said grip portion having a substantially rectangular cross-section, said cross section defining a second plane, said grip portion being positioned such that said second plane has an angular relationship to said first plane;

wherein said handle portion comprises a polymeric material; and wherein said brush member further comprises a plurality of bristle members interspersed across an exterior surface of said brush member, each one of said plurality of bristle members providing an abrasive force for facilitating cleaning the interior surface of the toilet;

wherein each one of said plurality of bristle members comprises an elastomeric material.

9. A toilet cleaning apparatus comprising:

a handle portion being substantially elongate, said handle portion having a proximal end and a distal end, said proximal end being adapted for grasping by a human hand;

a brush member being coupled to said distal end of said handle portion, said brush member being for cleaning an interior surface of a toilet;

said handle portion further comprises a grip portion coupled to said proximal end, said grip portion having a perimeter wall defining an aperture adapted for inserting the fingers of a human hand to facilitate gripping the handle;

said grip portion is positioned such that a longitudinal axis of said grip portion is substantially perpendicular to a longitudinal axis of said handle portion;

said handle portion comprises a polymeric material;

said brush member further comprises a plurality of bristle members interspersed across an exterior surface of said brush member, each one of said plurality of bristle members providing an abrasive force for facilitating cleaning the interior surface of the toilet;

each one of said plurality of bristle members is resiliently flexible for facilitating contact with the interior surface of the toilet;

each one of said plurality of bristle members comprises an elastomeric material;

said brush member being resiliently flexible for facilitating placement of said brush member substantially within a drain opening of the toilet for cleaning an interior surface of said drain opening;

said brush member being pivotally coupled to said handle portion for facilitating placement of said brush member against the interior surface of the toilet;

said handle portion has an overall length of approximately 14 ½ inches; and said brush member has a length of approximately 8 ¼ inches and a width of approximately 4 ¼ inches.

* * * * *